US008408145B2

(12) United States Patent
Chen

(10) Patent No.: US 8,408,145 B2
(45) Date of Patent: Apr. 2, 2013

(54) LINKED STRUCTURE FOR FOLDABLE TABLE

(76) Inventor: Te-Lung Chen, Tainan (TW)

( * ) Notice: Subject to any disclaimer, the term of this patent is extended or adjusted under 35 U.S.C. 154(b) by 0 days.

(21) Appl. No.: 12/930,432

(22) Filed: Jan. 7, 2011

(65) Prior Publication Data

US 2012/0174835 A1 Jul. 12, 2012

(51) Int. Cl.
*A47B 3/00* (2006.01)

(52) U.S. Cl. ..... 108/128; 108/115

(58) Field of Classification Search ..... 108/115, 108/118, 67, 77, 79, 80, 69, 72, 124, 128; 248/188.6

See application file for complete search history.

(56) References Cited

U.S. PATENT DOCUMENTS 1,062,996 A * 5/1913 Sornberger ..... 108/36
2,535,921 A * 12/1950 Hart ..... 108/155
3,214,217 A * 10/1965 Jente ..... 108/128
3,279,399 A * 10/1966 White ..... 108/38
4,067,266 A * 1/1978 Lafargue ..... 108/172
4,643,103 A * 2/1987 Jorgensen ..... 108/128
6,125,769 A * 10/2000 Tsai et al. ..... 108/118
6,792,880 B2 * 9/2004 Tsai ..... 108/115
6,874,427 B2 * 4/2005 Izumi ..... 108/34
7,337,731 B2 * 3/2008 Mu et al. ..... 108/67
D577,507 S * 9/2008 Collins et al. ..... D6/400
7,543,614 B2 * 6/2009 Wise ..... 108/69
2002/0139282 A1 * 10/2002 Liu ..... 108/131

* cited by examiner

*Primary Examiner* — Jose V Chen

(57) ABSTRACT

A linked structure for foldable table comprises a main frame, legs, props, connecting plate 1 and connecting plate 2. The main frame includes a plate body which connects multiple table plates with flexible wire on each side of the plate body. Each concave body and supporting leg is set under each end of the plate body. A connecting unit with a receiving concave is set in the concave body. The legs are set in the receiving concave of the connecting unit. Connecting plate 1 is set on the props on the connecting unit. Connecting plate 2 which set on the legs connects with connecting plate 1. The table plates are connected on each side of the plate body on main frame with flexible wire. When folding the present invention, the legs, props, connecting plate 1 and 2 are folded under the plate body through rotating the connecting unit.

15 Claims, 7 Drawing Sheets

LINKED STRUCTURE FOR FOLDABLE TABLE

BACKGROUND OF THE INVENTION

1. Field of the invention

This invention is related with a linked structure for foldable table which can be folded easily and fast in folding position through folding the legs, props, connecting plate 1 and connecting plate 2.

2. Description of the related art

As we know that there are many foldable tables on the market, and the ways of folding are also different. However, most of the foldable tables have the shortcomings with too many comprised members or too complicated folding steps which make it uneasily and slowly handling the whole structure.

SUMMARY

Referring to FIGS. 1 through 7, the linked structure for foldable table comprises a main frame, legs, props, connecting plate 1 and connecting plate 2. The main frame includes a plate body which connects multiple table plates with flexible wire on each side of the plate body. Each concave body and supporting leg is set under each end of the plate body. A connecting unit with a receiving concave is set in the concave body. The legs are set in the receiving concave of the connecting unit. Connecting plate 1 is set on the props which set on the connecting unit. Connecting plate 2 which set on the legs connects with connecting plate 1. The table plates are connected on each side of the plate body of main frame with flexible wire. When folding the present invention, the legs, props, connecting plates 1 and 2 are folded under the plate body through rotating the connecting unit. Therefore, the whole structure can be folded fast under the plate body of the main frame.

DETAILED DESCRIPTION OF THE INVENTION

Figure 1:
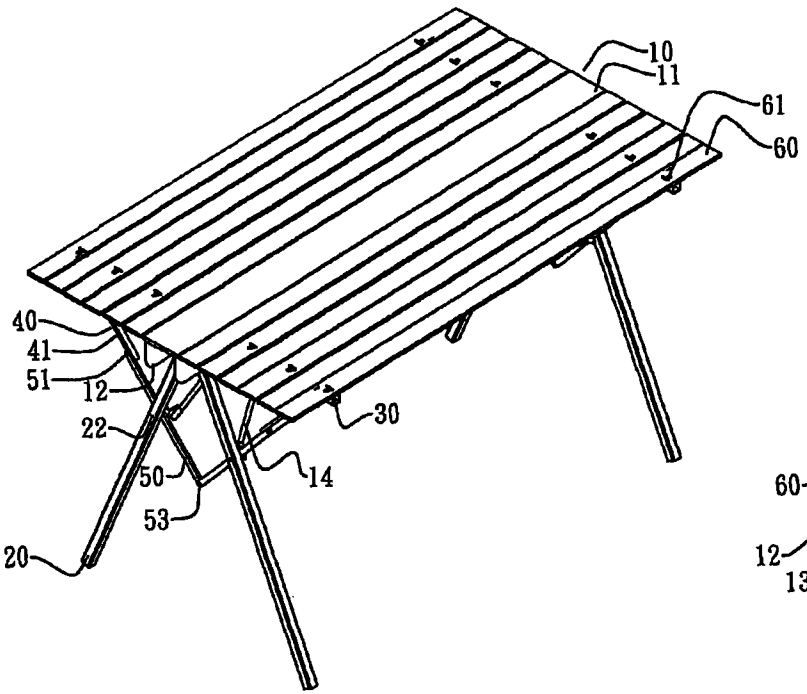
FIG. 1 is a schematic drawing illustrating the unfolded example of multiple table plates of the present invention.
Figure 8:
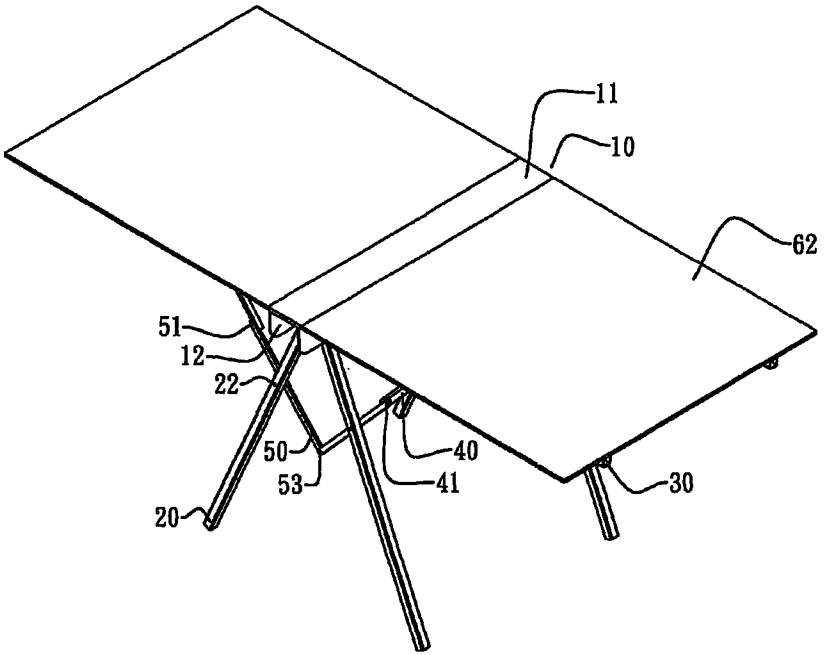
FIG. 8 is a schematic drawing illustrating the unfolded example of two boards of the present invention.

Referring to FIGS. 1 and 8, there are the examples of the present invention related with a linked structure for foldable table, which both comprise a main frame (10), legs (20), props (30), connecting plate 1 (40) and connecting plate 2 (50).

Figure 5:
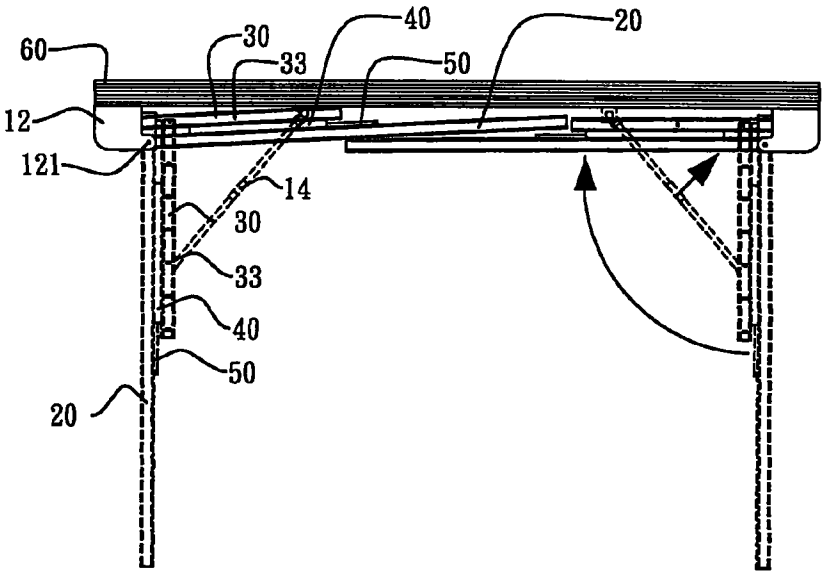
FIG. 5 is another schematic drawing illustrating the folded table of the present invention.
Figure 6:
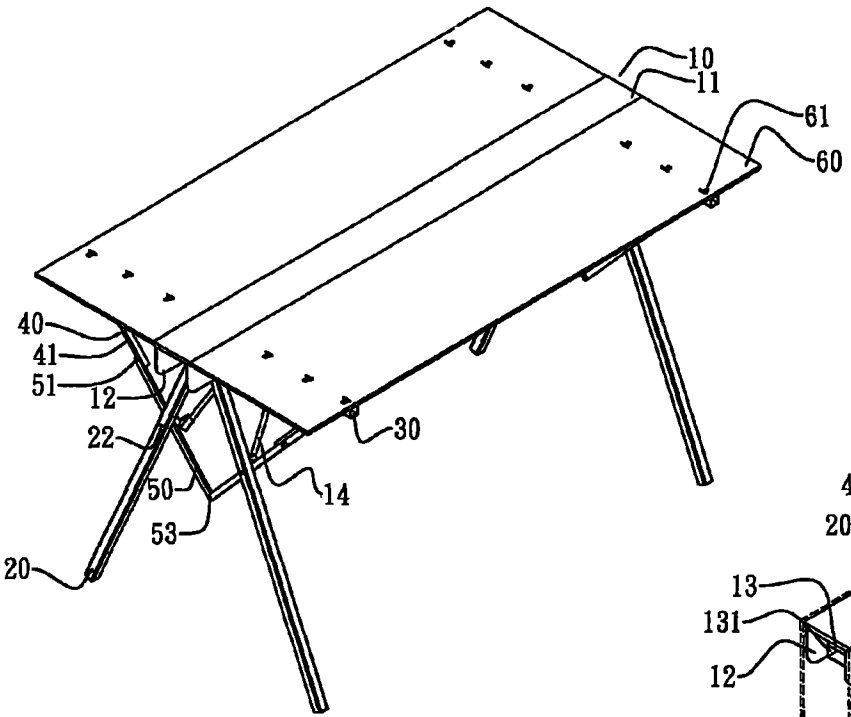
FIG. 6 is a schematic drawing illustrating the unfolded example of drop leafs of the present invention.
Figure 9:
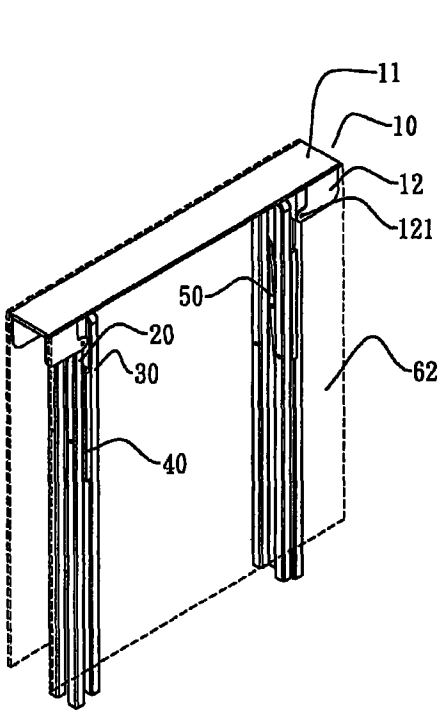
FIG. 9 is a schematic drawing illustrating the folded example of two boards of the present invention.

Referring to FIGS. 1 through 7, they are examples of the present invention, wherein the main frame (10) includes a long-shaped plate body (11) which connects table plates (60) with flexible wire on each side of the plate body (11). Each concave body (12) and supporting leg (14) is set under each end of the plate body (11). As shown in FIGS. 1, 2, 6 and 7, the drop leaf (60) can be multi-plate type or entire-plate type, yet the whole appearance is still a rectangular solid with long sides and wide brims. On each side under the drop leaf (60) there are tenon holes (61) set equidistantly. As shown in FIGS. 1 and 6, the tenon holes (61) which under the drop leaf (60) are marked for being understood easily, a connecting unit locking hole (121) is set on each bottom end of the concave body (12), and a connecting unit (13) is set inside the hollow space of the concave body (12). Inside the connecting unit (13) there is a receiving concave (131), and a concave body locking hole (132) which set on each narrow side end of the connecting unit (13) can be locked with the connecting unit locking hole (121) of the concave body (12) correspondingly, and the connecting unit (13) can be rotated through the connecting unit locking hole (121) as a fulcrum. Leg fitting holes (133) are set on the bottom end and prop fitting holes (134) are set on top end on the wide side of the connecting unit (13). The supporting leg (14) can be two-stage folded, which connects with connecting plate 2 (50). When the present invention is in unfolded position, the supporting leg (14) can support and make the whole structure stable.

Figure 3:
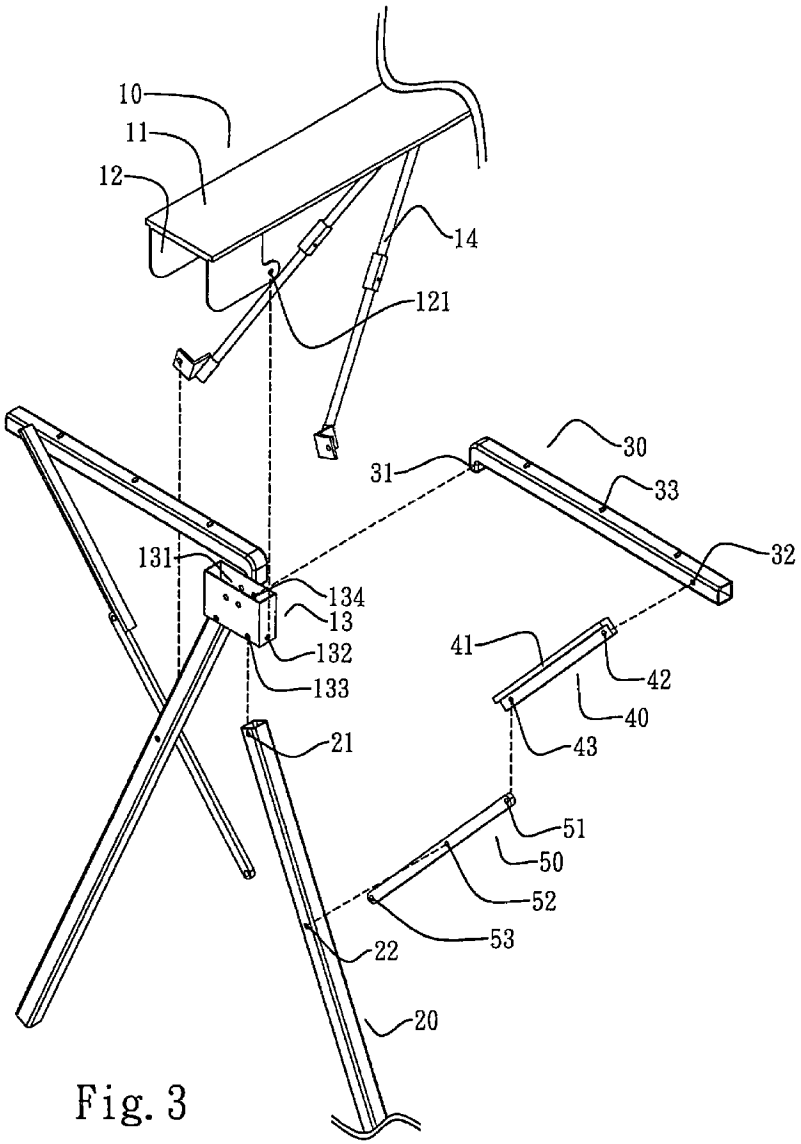
FIG. 3 is a perspective view illustrating the present invention.

Referring to FIG. 3, the leg (20) is set in the receiving concave (131) of the connecting unit (13), and a connecting unit fitting hole (21) on top end of the leg (20) can be locked with the leg fitting hole (133) on the connecting unit (13) correspondingly and rotate the leg (20) with the leg fitting hole (133) as a fulcrum. A connecting plate fitting hole (22) is set on the leg (20).

Referring to FIG. 3, the prop (30) is set on the connecting unit (13), and the length of the prop (30) is the same as the wide brim of the drop leaf (60). The front end of the prop (30) extends downwards to make it in L-shape. A connecting unit fitting hole (31) set on the extending part of the prop (30) can be locked with the prop fitting hole (134) on the connecting unit (13) correspondingly. The prop (30) can be rotated through the prop fitting hole (134) as a fulcrum. A connecting plate 1 fitting hole (32) is set on the prop (30), and many tenons (33) are set on the prop (30) equidistantly to make them locked with the tenon holes (61) on the drop leaf (60) correspondingly. Therefore, the drop leafs (60) can be set on the prop (30) stably through the tenons (33) and the tenon holes (61) locking each other.

Referring to FIG. 3, a blocker (41) is set on one edge of the connecting plate 1 (40) which set on the prop (30). The connecting plate 2 fitting hole (43) and the prop fitting hole (42) which can be correspondingly locked with the connecting plate 1 fitting hole (32) are set on the connecting plate 1 (40), therefore, it makes the connecting plate 1 (40) rotate through the connecting plate 1 fitting hole (32) as a fulcrum.

Referring to FIG. 3, the connecting plate 2 (50) is set on the leg (20) and is connected with the connecting plate 1 (40). A locking hole (53) is set on one end of the connecting plate 2 (50) and can be connected with another connecting plate 2 (50). A connecting plate 1 fitting hole (51) is set on another end of the connecting plate 2 (50) and can be locked correspondingly with the connecting plate 2 fitting hole (43). The connecting plate 2 (50) can be rotated through the connecting plate 2 fitting hole (43) as a fulcrum, but the range of its rotating is limited by the blocker (41) on the connecting plate 1 (40). A leg fitting hole (52) set on the connecting plate 2 (50) can be locked correspondingly with the connecting plate fitting hole (22) on the leg (20) and the connecting plate 2 (50) can be rotated through the connecting plate fitting hole (22) as a fulcrum. As shown in FIG. 1, the supporting leg (14) which set under the plate body (11) is connected with the connecting plate 2 (50) at leg fitting hole (52).

Figure 2:
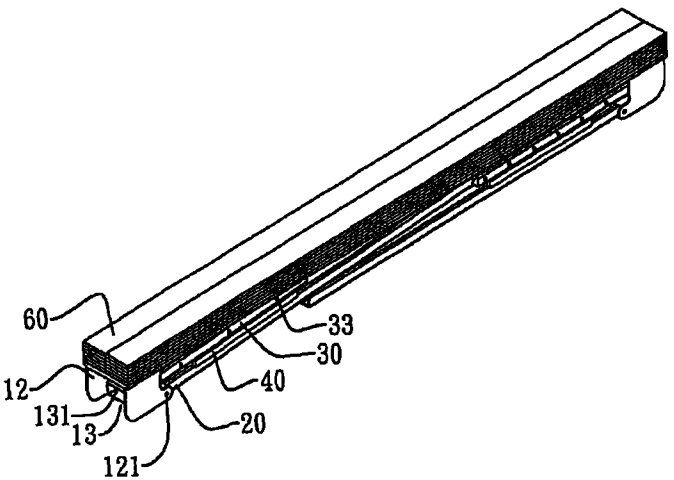
FIG. 2 is a schematic drawing illustrating the folded example of multiple table plates of the present invention.
Figure 4:
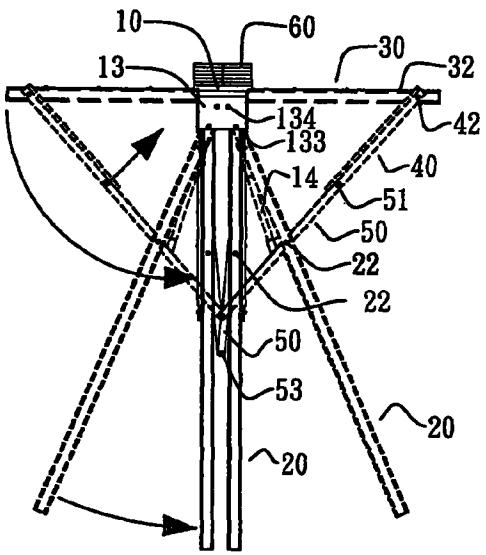
FIG. 4 is a schematic drawing illustrating the folded table of the present invention.
Figure 7:
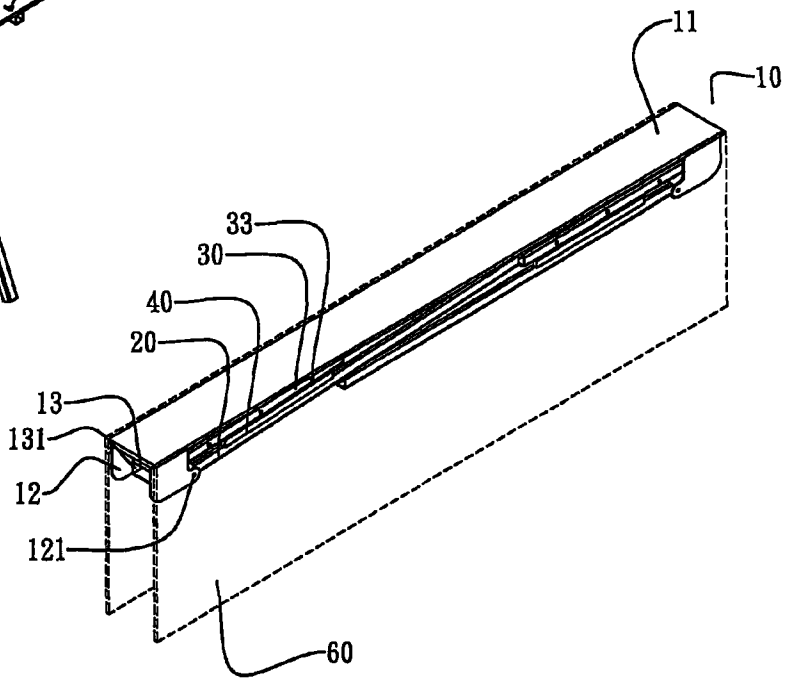
FIG. 7 is a schematic drawing illustrating the folded example of drop leafs of the present invention.

As shown in FIGS. 4 and 5, when the whole structure is in folding position, loose the drop leaf (60) from the prop (30) first. Pile the drop leaves (60) on the plate body (11) of the main frame (10) one by one in forward and then in reverse if the drop leaf (60) is multi-plate type (as shown in FIG. 2). If it is entire-plate type, as shown in FIG. 7, move the drop leaf (60) downwards, and rotate the prop (30) downwards to move the connecting plate 1 (40) close to the prop (30). Meanwhile, the connecting plate 2 (50) is driven by the connecting plate 1 (40) to move inwards, and the move of the connecting plate 2 (50) would narrow the open angle of the leg (20). When the prop (30) rotates downwards and is perpendicular with the plate body (11), the prop (30), the connecting plate 1 (40) and the leg would be parallel to each other. Rotate the connecting unit (13) inwards to move the prop (30), the connecting plate 1 (40), the connecting plate 2 (50), and the leg (20) close to the bottom of the plate body (11), and the supporting leg (14) is driven by the connecting plate 2 (50) being folded and then close to the bottom of the plate body (11). Therefore, the whole folding structure is completed.

Referring to FIGS. 4 and 5, when the whole structure is in unfolding position, rotate the connecting unit (13) downwards to open the supporting leg (14), and then rotate the prop (30) upwards to move the connecting plate 1 (40) downwards. Meanwhile, the connecting plate 2 (50) is driven by the connecting plate 1 (40) to move outwards, and the move of the connecting plate 2 (50) would expanse the open angle of the leg (20). The unfolding structure is completed when the prop (30) rotates upwards and is perpendicular with the plate body (11), the connecting plate 2 (50) leaning to the blocker (41) on the connecting plate 1 (40) is parallel to the connecting plate 1 (40), and then set the drop leaf (60) on the prop (30).

Another example of the present invention is shown in FIGS. 8 through 11, wherein the main frame (10) comprises a long-shaped plate body (11) and a board (62) which is connected on each side of the plate body (11) with flexible wire, and the whole appearance of the board (62) is still a rectangular solid with long sides and wide brims. A concave body (12) is set on each side at the bottom of the plate body (11). The entire-plate-type board (62) is locked on the prop (30). A connecting unit locking hole (121) is set on the bottom of the concave body (12), and a connecting unit (13) is set inside the hollow space of the concave body (12). Inside the connecting unit (13) there is a receiving concave (131), and a concave body locking hole (132) which set on each narrow side end of the connecting unit (13) can be locked with the connecting unit locking hole (121) of the concave body (12) correspondingly. The connecting unit (13) cannot be rotated. A leg fitting hole (133) and a prop fitting hole are set on the front side of the connecting unit (13).

Figure 10:
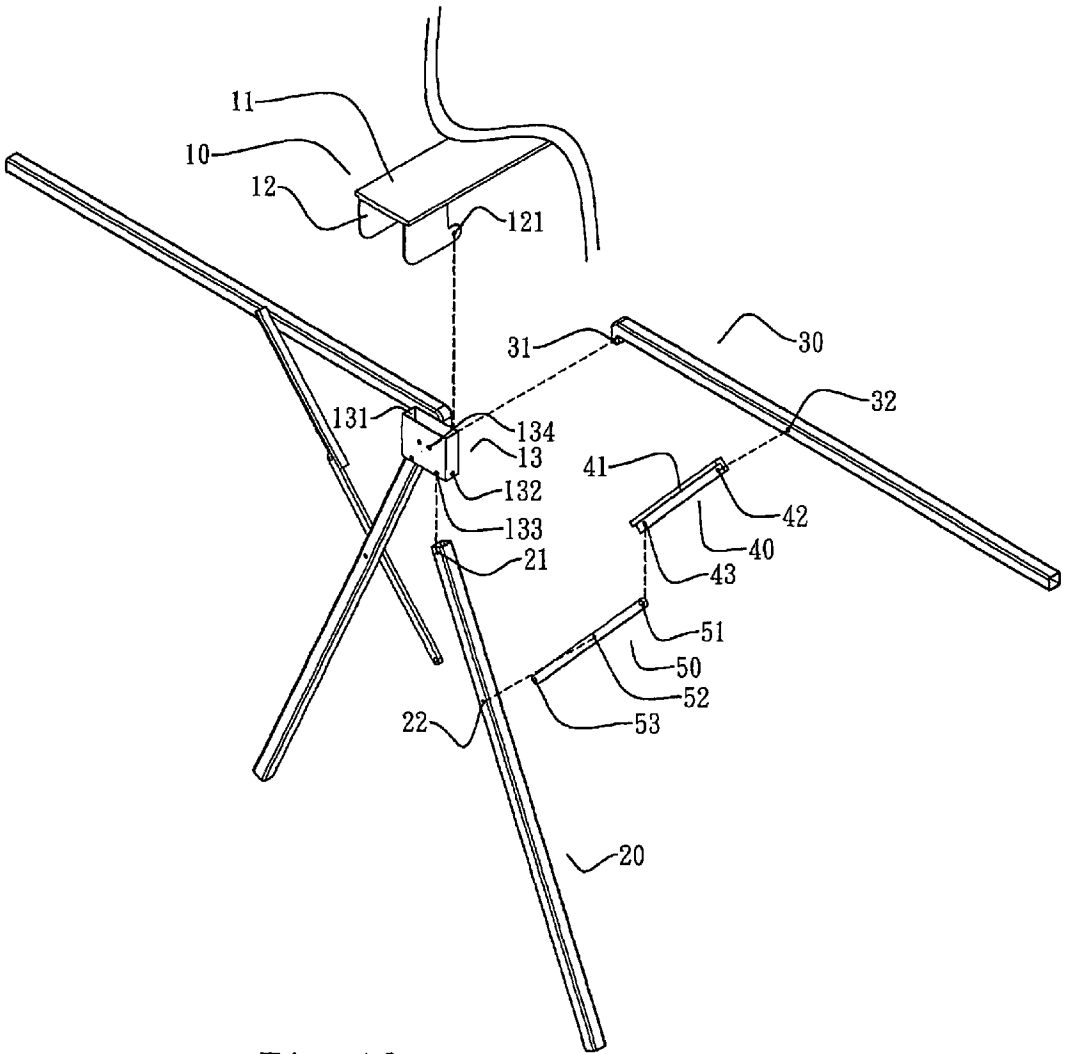
FIG. 10 is a perspective view illustrating the example of two boards of the present invention.

Referring to FIG. 10, the leg (20) is set in the receiving concave (131) of the connecting unit (13), and a connecting unit fitting hole (21) on top end of the leg (20) can be locked with the leg fitting hole (133) on the connecting unit (13) correspondingly and rotate the leg (20) through the leg fitting hole (133) as a fulcrum. A connecting plate fitting hole (22) is set on the leg (20).

Referring to FIG. 10, the prop (30) is set on the connecting unit (13), and the length of the prop (30) is the same as the wide brim of the board (62). The front end of the prop (30) extends downwards to make it in L-shape. A connecting unit fitting hole (31) set on the extending part of the prop (30) can be locked with the prop fitting hole (134) on the connecting unit (13) correspondingly. The prop (30) can be rotated through the prop fitting hole (134) as a fulcrum. A connecting plate 1 fitting hole (32) is set on the prop (30). Referring to FIG. 10, a blocker (41) is set on one edge of the connecting plate 1 (40) which set on the prop (30). The connecting plate 2 fitting hole (43) and the prop fitting hole (42) which can be correspondingly locked with the connecting plate 1 fitting hole (32) are set on the connecting plate 1 (40), therefore, it makes the connecting plate 1 (40) rotate through the connecting plate 1 fitting hole (32) as a fulcrum.

Referring to FIG. 10, the connecting plate 2 (50) is set on the leg (20) and is connected with the connecting plate 1 (40). A locking hole (53) is set on one end of the connecting plate 2 (50) and can be connected with another connecting plate 2 (50). A connecting plate 2 fitting hole (51) is set on another end of the connecting plate 2 (50) and can be locked correspondingly with the connecting plate 2 fitting hole (43). The connecting plate 2 (50) can be rotated through the connecting plate 2 fitting hole (43) as a fulcrum, but the range of its rotating is limited by the blocker (41) on the connecting plate 1 (40). A leg fitting hole (52) set on the connecting plate 2 (50) can be locked correspondingly with the connecting plate fitting hole (22) on the leg (20) and the connecting plate 2 (50) can rotate through the connecting plate fitting hole (22) as a fulcrum.

Figure 11:
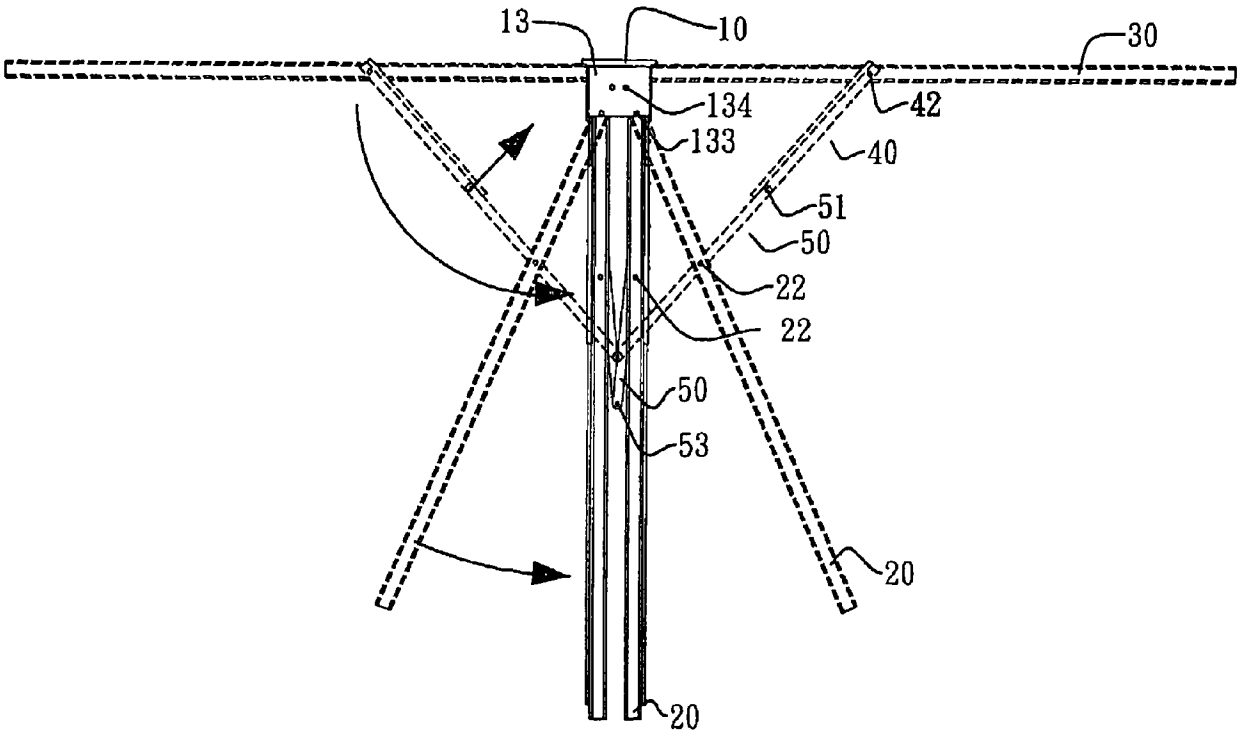
FIG. 11 is a schematic drawing illustrating the folded example of two boards of the present invention.

Referring to FIG. 11, when the whole structure is in folding position, rotate the prop (30) downwards to move the connecting plate 1 (40) close to the prop (30). Meanwhile, the connecting plate 2 (50) is driven by the connecting plate 1 (40) to move inwards, and the move of the connecting plate 2 (50) would narrow the open angle of the leg (20). When the prop (30) rotates downwards and is perpendicular with the plate body (11), the prop (30), the connecting plate 1 (40) and the leg would be parallel to each other. Therefore, the whole folding structure is completed.

Referring to FIG. 11, when the whole structure is in unfolding position, rotate the prop (30) upwards to move the connecting plate 1 (40) downwards. Meanwhile, the connecting plate 2 (50) is driven by the connecting plate 1 (40) to move outwards, and the move of the connecting plate 2 (50) would expanse the open angle of the leg (20). The unfolding structure is completed when the prop (30) rotates upwards and is perpendicular with the plate body (11), the connecting plate 2 (50) leaning to the blocker (41) on the connecting plate 1 (40) is parallel to the connecting plate 1 (40), and then set the board (62) on the prop (30).

I claim:

1. A linked structure for a foldable table comprising:

a narrow, rectangular plate body, the plate body having an upper surface, a lower surface, at least a first long edge, a proximal narrow end and a distal narrow end;

at least a first drop leaf, the drop leaf comprising at least a first table plate having at least a first edge, the first edge of the first table plate aligned with and flexibly attached to the first long edge of the plate body;

a first concave body and a second concave body, the first concave body attached to the lower surface of the plate body near the proximal narrow end of the plate body, the second concave body attached to the lower surface of the plate body near the distal narrow end of the plate body, each concave body having a pair of connecting unit locking holes disposed on opposing sides of the concave body;

a first connecting unit and a second connecting unit, the connecting units comprising hollow rectangular boxes with opposing narrow sides, opposing wide sides, and opposing upper and lower open ends that open into receiving concaves, the interior of the first connecting unit comprising a first receiving concave, the interior of the second connecting unit comprising a second receiving concave, the first connecting unit disposed within the first concave body and pivotably fastened to the connecting unit locking holes of the first concave body, the second connecting unit disposed within the second concave body and pivotably fastened to the connecting unit locking holes of the second concave body;

a first leg, a second leg, a third leg, and a fourth leg, each leg having an upper and a lower end, the upper ends of the first and second legs entering the first receiving concave through the lower open end of the first connecting unit, the upper ends of the third and fourth legs entering the second receiving concave through the lower open end of the second connecting unit, the first and second legs pivotably attached to the first connecting unit between the opposing wide sides of the first connecting unit, the third and fourth legs pivotably attached to the second connecting unit between the opposing wide sides of the second connecting unit;

at least a first prop and a second prop, the first prop parallel and pivotably attached to a wide side of the first connecting unit, the second prop parallel and pivotably attached to a wide side of the first connecting unit, the props operable to pivot to a horizontal orientation to support the drop leaf, the first prop further operable to pivot to a storage position parallel to the first leg, the second prop further operable to pivot to a storage position parallel to the second leg; and a first connecting plate having upper and lower ends, a second connecting plate have upper and lower ends, a third connecting plate having upper and lower ends, a fourth connecting plate having upper and lower ends, the upper end of the first connecting plate pivotably attached to the first prop, the lower end of the first connecting plate pivotably attached to the upper end of the second connecting plate, the lower end second connecting plate pivotably attached to the lower end of the third connecting plate, the upper end of the third connecting plate pivotably attached to the lower end of the fourth connecting plate, the upper end of the fourth connecting plate pivotably attached to the second prop, the second connecting plate pivotably attached to the first leg at a point between the upper and lower ends of the second connecting plate, the third connecting plate pivotably attached to the second leg at a point between the upper and lower ends of the third connecting plate.

2. A linked structure for a foldable table as recited in claim 1, wherein said drop leaf can be multi-plate type or entire-plate type.

3. A linked structure for a foldable table as recited in claim 1, further comprising concave body locking holes, wherein fasteners are passed through said concave body locking holes and through such that connecting units can be rotated.

4. A linked structure for a foldable table as recited in claim 1, wherein a fastener is passed through a connecting unit fitting hole on a top end of a leg and a leg fitting hole on a connecting unit such that the leg can be rotated about the leg fitting hole.

5. A linked structure for a foldable table as recited in claim 1, wherein a fastener passes through a connecting unit fitting hole and a prop fitting hole such that a prop can be rotated about the prop fitting hole.

6. A linked structure for a foldable table as recited in claim 1, wherein tenons protruding from a prop are inserted into tenon holes in a drop leaf.

7. A linked structure for a foldable table as recited in claim 1, further comprising at least a first supporting leg, an upper end of the supporting leg pivotably attached to the plate body, a lower end of the supporting leg pivotably attached to the first leg, the supporting leg having a central hinge such that the supporting leg may fold back upon itself.

8. A linked structure for a foldable table as recited in claim 1, wherein a first connecting plate additionally comprises a block such that a second connecting plate that is pivotably attached to the first connecting plate is prevented from pivoting in a first direction beyond an orientation wherein the first connecting plate and second connecting plate are parallel.

9. A linked structure for a foldable table comprising a narrow, rectangular plate body, the plate body having an upper surface, a lower surface, a first long edge, a second long edge, a proximal narrow end and a distal narrow end;

a first drop leaf and a second drop leaf, each drop leaf comprising a table plate having at least a first edge, the first edge of the first drop leaf table plate aligned with and flexibly attached to the first long edge of the plate body, the first edge of the second drop leaf table plate aligned with and flexibly attached to the second long edge of the plate body;

a first concave body and a second concave body, the first concave body attached to the lower surface of the plate body near the proximal narrow end of the plate body, the second concave body attached to the lower surface of the plate body near the distal narrow end of the plate body, each concave body having a pair of connecting unit locking holes disposed on opposing sides of the concave body;

a first connecting unit and a second connecting unit, the connecting units comprising hollow rectangular boxes with opposing narrow sides, opposing wide sides, and opposing upper and lower open ends that open into receiving concaves, the interior of the first connecting unit comprising a first receiving concave, the interior of the second connecting unit comprising a second receiving concave, the first connecting unit fixed within the first concave body, the second connecting unit fixed within the second concave body;

a first leg, a second leg, a third leg, and a fourth leg, each leg having an upper and a lower end, the upper ends of the first and second legs entering the first receiving concave through the lower open end of the first connecting unit, the upper ends of the third and fourth legs entering the second receiving concave through the lower open end of the second connecting unit, the first and second legs pivotably attached to the first connecting unit between the opposing wide sides of the first connecting unit, the third and fourth legs pivotably attached to the second connecting unit between the opposing wide sides of the second connecting unit;

a first prop and a second prop, the first drop leap fixed to the first prop, the second drop leaf fixed to the second prop, the first prop parallel and pivotably attached to a wide side of the first connecting unit, the second prop parallel and pivotably attached to a wide side of the first connecting unit, the props operable to pivot to a horizontal orientation, the first prop further operable to pivot to a storage position parallel to the first leg, the second prop further operable to pivot to a storage position parallel to the second leg; and a first connecting plate having upper and lower ends, a second connecting plate have upper and lower ends, a third connecting plate having upper and lower ends, a fourth connecting plate having upper and lower ends, the upper end of the first connecting plate pivotably attached to the first prop, the lower end of the first connecting plate pivotably attached to the upper end of the second connecting plate, the lower end second connecting plate pivotably attached to the lower end of the third connecting plate, the upper end of the third connecting plate pivotably attached to the lower end of the fourth connecting plate, the upper end of the fourth connecting plate pivotably attached to the second prop, the second connecting plate pivotably attached to the first leg at a point between the upper and lower ends of the second connecting plate, the third connecting plate pivotably attached to the second leg at a point between the upper and lower ends of the third connecting plate.

10. A linked structure for a foldable table as recited in claim 9, wherein a concave body locking hole on each connecting unit is pivotably fastened to a connecting unit locking hole.

11. A linked structure for a foldable table as recited in claim 9, wherein a connecting unit fitting hole on a leg is pivotably fastend to a leg fitting hole on a connecting unit such that the leg can be rotated about the leg fitting hole.

12. A linked structure for a foldable table as recited in claim 9, wherein a connecting unit fitting hole in a prop is pivotably fastened to a prop fitting hole in a connecting unit such that the prop can be rotated about the prop fitting hole.

13. A linked structure for a foldable table as recited in claim 9, wherein a prop fitting hole in a first connecting plate is pivotably fastened to a connecting plate fitting hole in a prop such that the first connecting plate can be rotated about the first connecting plate fitting hole.

14. A linked structure for foldable table as recited in claim 9, wherein a first connecting plate additionally comprises a block such that a second connecting plate that is pivotably attached to the first connecting plate is prevented from pivoting in a first direction beyond an orientation wherein the first connecting plate and second connecting plate are parallel.

15. A linked structure for a foldable table as recited in claim 9, wherein a leg fitting hole is a second connecting plate is pivotably fastened to a connecting plate fitting hole in a leg such that the second connecting plate can be rotated about the connecting plate fitting hole.

* * * * *